US012629603B2

(12) United States Patent
Adams et al.

(10) Patent No.: US 12,629,603 B2
(45) Date of Patent: May 19, 2026

(54) SYSTEMS AND METHODS FOR CONTROLLING A RADIO-CONTROLLED TWO-WHEELED VEHICLE

(71) Applicant: HORIZON HOBBY, LLC, Champaign, IL (US)

(72) Inventors: John Adams, Champaign, IL (US); Matthew W. Olson, Champaign, IL (US)

(73) Assignee: Horizon Hobby, LLC, Champaign, IL (US)

( * ) Notice: Subject to any disclaimer, the term of this patent is extended or adjusted under 35 U.S.C. 154(b) by 526 days.

(21) Appl. No.: 18/298,215

(22) Filed: Apr. 10, 2023

(65) Prior Publication Data

US 2024/0335758 A1 Oct. 10, 2024

(51) Int. Cl.

| | |
|---|---|
| ***A63H 17/36*** | (2006.01) |
| ***A63H 17/21*** | (2006.01) |
| ***A63H 30/04*** | (2006.01) |

(52) U.S. Cl.

CPC ..... *A63H 17/36* (2013.01); *A63H 17/21* (2013.01); *A63H 30/04* (2013.01)

(58) Field of Classification Search

CPC ..... A63H 17/004; A63H 17/21; A63H 17/36; A63H 17/395; A63H 30/04

See application file for complete search history.

(56) References Cited

U.S. PATENT DOCUMENTS 4,267,663 A * 5/1981 Nagahara ..... A63H 17/36 446/440
6,438,463 B1 * 8/2002 Tobaru ..... B60G 17/018 701/1
6,482,069 B1 11/2002 Tilbor et al.
7,503,828 B2 * 3/2009 Lee ..... A63H 17/36 446/460
9,056,667 B2 6/2015 Burch et al.
(Continued)

FOREIGN PATENT DOCUMENTS

CN 113739794 A * 12/2021 ..... G05D 1/49
DE 112015005062 T5 * 7/2017 ..... A63H 17/395
(Continued)

OTHER PUBLICATIONS

Horizon Hobby, 1/4 Promoto-MX Motorxycle RTR, FXR, printed Jul. 11, 2023, https://www.horizonhobby.com/product/1-4-promoto-mx-motorcycle-rtr/LOS06000.html.
(Continued)

*Primary Examiner* — Steven J Hylinski
(74) *Attorney, Agent, or Firm* — Fredrikson & Byron, P.A.

(57) ABSTRACT

A radio-controlled (RC) motorcycle is disclosed with a chassis, a rear wheel, and a steerable front wheel assembly. The motorcycle includes an attitude estimator that uses rotation and acceleration data from an IMU to estimate an inertial attitude of the motorcycle. A receiver is connected to a control processor and receives a steering input from an RC transmitter. The control processor determines a desired roll angle based at least in part on the steering input from the receiver; determines a reported roll angle from the attitude estimate; and controls a steering angle of the front wheel assembly to reduce the difference (or reduce error) between the desired roll angle and the reported roll angle.

17 Claims, 6 Drawing Sheets

(56) References Cited

U.S. PATENT DOCUMENTS

| | | | | |
|---|---|---|---|---|
| 9,320,977 | B2 | 4/2016 | Beard et al. | |
| 10,245,952 | B1 | 4/2019 | Patterson et al. | |
| 2004/0098185 | A1* | 5/2004 | Wang | B62D 61/02 701/91 |
| 2009/0264046 | A1 | 10/2009 | Mayer | |
| 2015/0094880 | A1* | 4/2015 | Beard | A63H 17/36 701/2 |

FOREIGN PATENT DOCUMENTS

| | | | | | |
|---|---|---|---|---|---|
| GB | 2568912 | A | * | 6/2019 | A63H 17/21 |
| JP | H02236172 | A | * | 9/1990 | |
| JP | 2006020652 | A | * | 1/2006 | |
| JP | 7547865 | B2 | * | 9/2024 | |
| WO | WO-2004054678 | A1 | * | 7/2004 | A63H 17/395 |

OTHER PUBLICATIONS

Horizon Hobby, DSMR 6CH Receiver—ProMoto, printed Jul. 11, 2023, https://www.horizonhobby.com/product/dsmr-6ch-receiver---promoto/SPMSR6300PM.html.

* cited by examiner

SYSTEMS AND METHODS FOR CONTROLLING A RADIO-CONTROLLED TWO-WHEELED VEHICLE

BACKGROUND

Field of the Disclosure

The disclosure relates generally to systems and methods for controlling a radio-controlled (RC) two-wheeled vehicle, and in particular, to dynamic inertial stabilization systems and methods that affect handling, response, control, and/or balance of RC two-wheeled vehicles.

Description of the Related Art

RC vehicles are self-powered vehicles controlled by an operator from a distance with a specialized transmitter. Many types of full-scale vehicles have been successfully miniaturized into RC vehicles, including planes, helicopters, cars, and boats. One type of vehicle that has been difficult to replicate for remote operation is the two-wheel vehicle, such as a motorcycle or bicycle.

Unlike planes, helicopters, cars, and boats, the elements allowing motorcycle and other two-wheel vehicle operators to maintain vehicle stabilization and control are difficult to replicate for remote operation. For example, a cyclist uses their vestibular system to continuously sense the necessary adjustments of the bicycle's controls to maintain balance. On the other hand, a remote operator is limited to visual cues of the two-wheeled vehicle. Furthermore, only having two contact points with the ground creates an inherently unstable vehicle platform. Any lateral instability falls into a positive feedback loop of further instability unless a counteracting force is applied.

Previous RC motorcycles attempted to use a combination of mechanical geometry (fork rake angle, trail caster effect, etc.) and an onboard flywheel to improve the lateral stabilization of the RC motorcycle. But those mechanisms only offer limited stability and fail to address the primary issue with RC motorcycle stabilization. Those previous RC motorcycles pair the steering input from the transmitter to the front wheel direction of the motorcycle, making the RC motorcycle very difficult to accurately control and to keep upright especially over rough terrain. Because the RC motorcycle regularly crashes and falls, the operator must frequently walk to the downed RC motorcycle, recover it by hand, and stand the RC motorcycle upright while engaging the throttle. This has led to very limited adoption of RC two-wheeled vehicles by RC hobbyists.

Another previous RC motorcycle uses rollers along the rear tire to maintain the RC motorcycle upright and balanced. While reducing the probability of a crash or fall while stationary or at slow speeds, these complicated mechanisms reduce the realism of the model RC motorcycle, limit its maximum speed, and have difficulty over rough, wet, or loose terrain.

SUMMARY

Innovative aspects of the subject matter described in this specification may be embodied in a method of controlling an RC two-wheeled vehicle by (i) receiving an input steering command from a radio transmitter, (ii) converting the input steering command from the receiver to a targeted roll angle for the RC two-wheeled vehicle, (iii) measuring the current monitored roll angle of the RC two-wheeled vehicle, (iv) comparing the targeted roll angle to the monitored roll angle, (v) converting the input steering command to an output steering command through the use of a closed-loop control system that attempts to reduce error between the monitored roll angle and the targeted roll angle, and (vi) steering the RC two-wheeled vehicle based on the output steering command, sending the output steering command to at least one steering servomotor on the RC two-wheeled vehicle. Unlike previous RC motorcycles, the operator does not steer the vehicle by directly controlling the orientation of the front wheel. Instead, the operator commands a target roll angle and the onboard stability control system manipulates the motorcycle's steering angle to achieve the commanded specific roll angle.

The onboard stability control system may use inertial measurement units with angular rate sensors configured to output rotation data and acceleration sensors configured to output acceleration data. The onboard stability control system may output the rotation data, acceleration data, and/or attitude estimates.

A steering system that works by commanding a specific roll angle delivers the best remote-control analog to steering response and accuracy. It also provides the best experience for operators seeking a realistic simulation of the full-scale vehicle. The mechanisms for maintaining the stability of two-wheeled vehicles are unintuitive, and nearly all riders fail to grasp the complexity of the vehicles they ride or their actions as they ride. This makes providing an intuitive steering mechanism for an RC two-wheeled vehicle particularly onerous. One of the most unintuitive aspects is steering. Manipulating the handlebars to shift the front of the front wheel to the left is considered turning left.

However, attempting to initiate a turn by "turning left" will cause the vehicle to turn right. When initiating a turn, a person must counter-steer away from the intended direction of travel. This causes the vehicle and rider's center of gravity to shift from its stable position centered between the wheels to the side of the vehicle in the intended direction of travel. Due to the center of gravity shift, the vehicle begins falling in that direction. By moving the vehicle forward, the mechanical design of the vehicle converts the falling into a turning radius in the intended direction of travel. Once the desired turning radius has been achieved, the rider steers the handlebars into the turn. Steering the handlebars into the turn does not cause the turn. Instead, it stops the rider from turning more—which would result in falling to the ground—by stopping the center of gravity from moving farther away from the wheels' contact points. Subconsciously, the rider is almost constantly counter-steering the vehicle to maintain balance. However, consciously, the rider steers by selecting a turning radius through appropriate speed control and roll orientation of the vehicle-rider system. The preferred embodiment allows the operator of an RC two-wheeled vehicle to consciously control the steering of the RC vehicle, likewise by managing the subconscious counter-steering through a control processor.

Other embodiments of these aspects include corresponding systems, apparatus, and computer programs, configured to perform the actions of the methods, encoded on computer storage devices.

These and other embodiments may each optionally include one or more of the following features. Stabilization along the yaw axis can control sliding and the loss of control over uneven terrain and during hard deceleration and acceleration. Wheelie stabilization prevents the vehicle from flipping during hard acceleration and allows the operator to maintain a wheelie for a sustained period by merely holding the throttle trigger down. Self-recovery allows the vehicle to right itself from a downed position to an upright position using only commands from the transmitter.

Particular implementations of the subject matter described in this specification can be implemented to realize one or more of the following advantages. For example, an operator can start the RC two-wheeled vehicle from a downed position, avoiding potentially dangerous situations where the operator is attempting to hold the transmitter pulling the throttle trigger while also holding an operational RC two-wheeled vehicle upright with its wheels spinning. Furthermore, the operator avoids the necessity of walking to the vehicle every time it falls to pick it up and attempting the potentially dangerous startup procedure. As another example, an operator can more easily keep the RC motorcycle upright in rough terrain. As another example, an operator can keep the RC motorcycle in a wheelie position for longer.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

This disclosure discusses methods and systems for improved stabilization of an RC motorcycle. In the following description, details are set forth by way of example to facilitate discussion of the disclosed subject matter. It should be apparent to a person of ordinary skill in the field, however, that the disclosed embodiments are exemplary and not exhaustive of all possible embodiments, including that the disclosure is not limited to two-wheeled vehicles or motorcycles.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-6 wherein like numbers are used to indicate like and corresponding parts.

Figure 1:
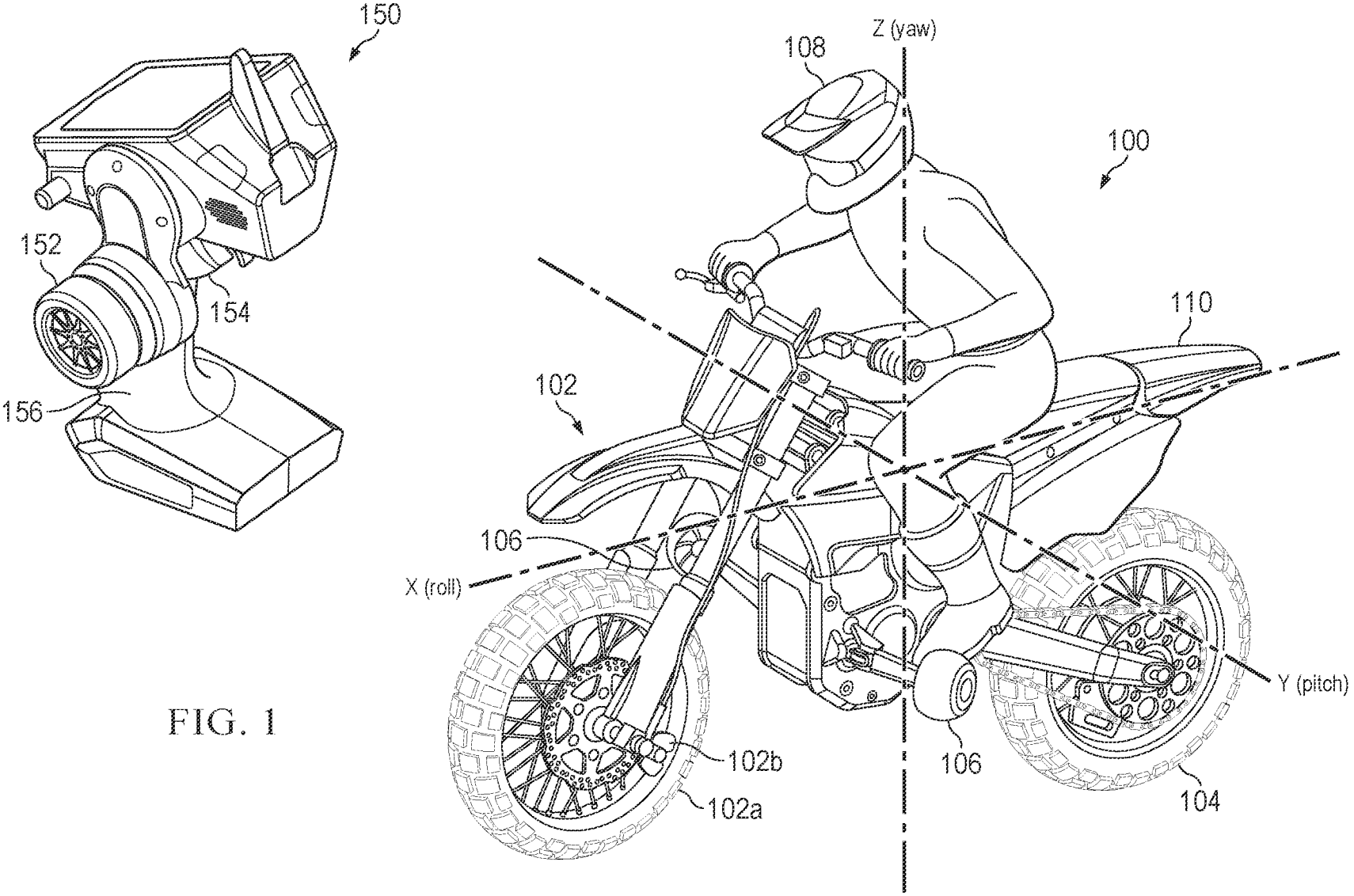
FIG. 1 illustrates an RC two-wheeled vehicle and transmitter according to an example embodiment.

Turning now to the drawings, FIG. 1 illustrates an RC motorcycle 100 and transmitter 150 according to an example embodiment. The motorcycle 100 comprises a front assembly 102 with a front wheel 102*a*, rear wheel 104, lean bars 106, model rider 108, and chassis 110. The transmitter 150 comprises a steering wheel 152, a throttle trigger 154, and a hand grip 156. The steering wheel 152 is coupled to upper right side of the hand grip 156. The throttle trigger 154 is coupled to the front of the hand grip 156. The motorcycle 100 may move about and along a roll axis, pitch axis, and yaw axis.

The front assembly 102 connects to the front of the chassis 110 and rotates about the steering axis in the same manner as a full-scale two-wheel vehicle. The front wheel 102*a* and front brake 102*b* are both part of the front assembly 102. The rear wheel 104 connects to a swing arm on the chassis 110 and rotates to provide forward acceleration and braking. The lean bars 106 are a type of angle limiter that are coupled to the lower portion on each side of the chassis 106 near the midpoint and assist in stability and self-recovery. Angle limiters are meant to prevent or reduce the chance of the vehicle falling over and can take different shapes and forms, such as the lean bars 106 shown in FIG. 3. The model rider 108 is coupled to the top of the chassis 110, improves the realism of the motorcycle 100 and can aid in self-recovery after the vehicle tumbles. In some embodiments, a rear brake (not shown) may be part of a rear assembly with the rear wheel.

In some embodiments, the model rider 108 may move—or move an internal weight—based on operator input and/or attitude measurements to assist in stability, self-recovery, or the realism of the simulated rider. In such embodiments, the model rider 108 or internal weight may move away from the intended turning direction at slower speeds but into the intended turn direction of travel at higher speeds to improve stability across all travel speeds. In other embodiments, the lean bars 106 may be retractable or may be integrated into the model rider 108 to appear as part of the model rider, e.g., feet and legs.

Radio-frequency (RF) commands are sent from the transmitter module on the transmitter to the receiver module on the RC two-wheeled vehicle.

To control the speed of the RC two-wheeled vehicle, the operator holds the hand grip 156 and manipulates the throttle trigger 154 with their index finger. Pulling the throttle trigger 154 causes the rear wheel 104 to rotate forward. Disengaging the trigger stops adding rotational energy to the rear wheel 104, causing the motorcycle 100 to slow and eventually stop. Pushing the throttle trigger 154 forward causes the rear wheel 104 to brake, actively slowing the motorcycle 100. The operator controls the steering of the motorcycle 100 with their hand by rotating the steering wheel 152. The steering wheel 152 is spring tensioned to return to a neutral, middle position. The front assembly 102 rotates along the steering axis in response to commands from a control processor.

Furthermore, the two-wheeled vehicle has an internal flywheel near the vehicle's center of inertia that is connected to an electric motor. The flywheel is oriented along the medial plane of the vehicle and rotates counterclockwise when looking at the vehicle's left side. The flywheel assists the self-recovery function of the vehicle and improves overall stability in two ways. First, the flywheel improves stability by creating angular momentum that resists rotation in the roll and yaw axis of the vehicle. Second, when the vehicle experiences a yaw force, the flywheel will torque the vehicle's lean angle in a manner that corrects for the directional change of the vehicle. For example, if the vehicle experiences a bump that rotates vehicle clockwise from above, the gyroscopic precession of the forward spinning flywheel will create a torque on the vehicle causing it to lean further to the left counteracting the initial turn caused by the bump.

Other embodiments may have a transmitter with one or more thumbsticks instead of the steering wheel and trigger. Moving a thumbstick forward or backward corresponds to manipulating the trigger, and moving a thumbstick left or right corresponds to rotating the steering wheel. Further embodiments may cause the rear wheel to rotate forward slowly in response to no operator input from the trigger and stop in response to pushing the trigger forward. Other embodiments may not include the model rider or the lean bars.

Figure 2:
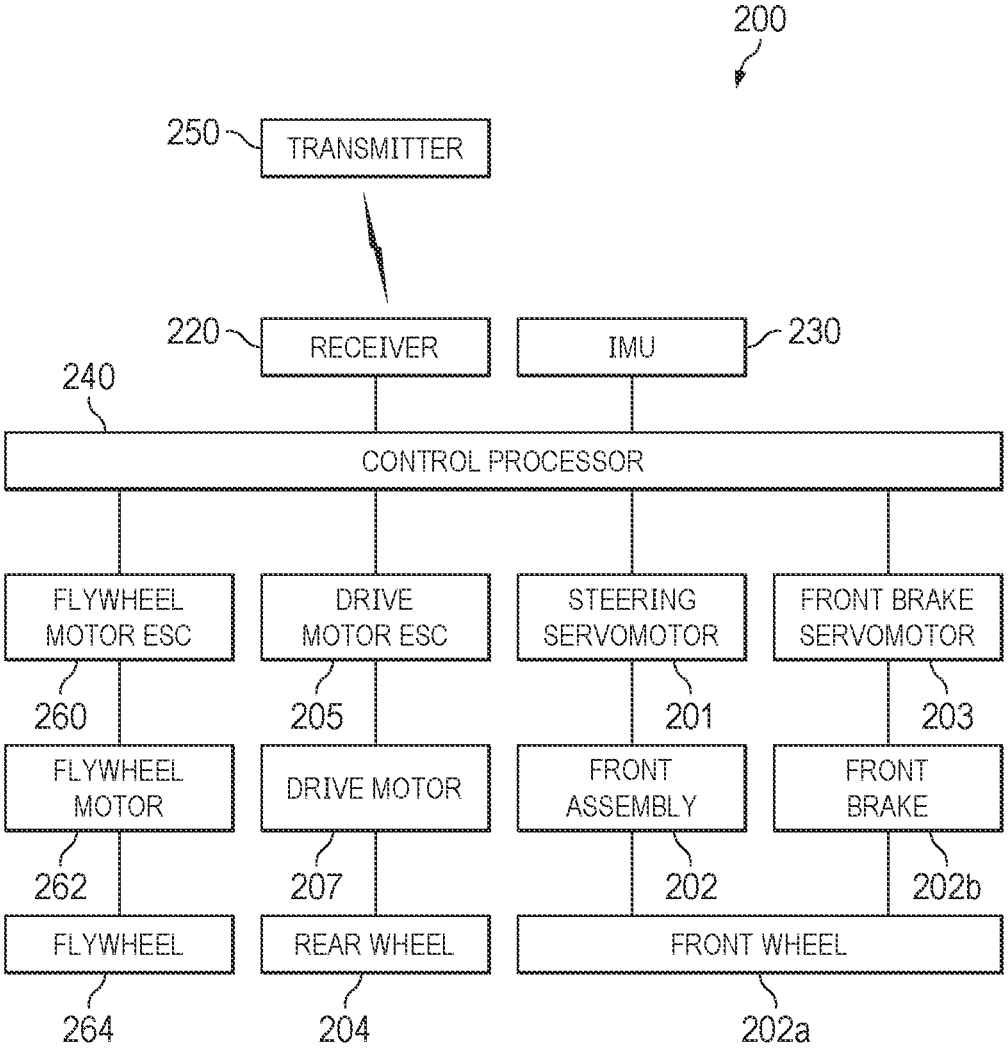
FIG. 2 illustrates a simplified block diagram of an RC two-wheeled vehicle system, according to an example embodiment.

FIG. 2 illustrates a simplified block diagram of an RC two-wheeled vehicle system according to the example embodiment. The RC two-wheeled vehicle system 200 comprises a remote transmitter 250, receiver 220, inertial measurement unit (IMU) 230, flywheel motor electronic speed controller (ESC) 260, flywheel motor 262, flywheel 264, drive motor ESC 205, drive motor 207, rear wheel 204, steering servomotor 201, front wheel assembly 202, front brake servomotor 203, front brake 202*b*, and front wheel 202*a*.

The transmitter 250 connects to the receiver 220 over an RF link. The receiver 220 and IMU 230 connect to the control processor 240 and provide inputs. The control processor 230 is also connected to the flywheel motor ESC 260, drive motor ESC 205, steering servomotor 201, and front brake servomotor 203. The flywheel servomotor ESC 260 also connects to the flywheel motor 262, which is connected to the flywheel 264. The drive motor ESC 205 also connects to the drive motor 207, which is—in turn—connected to the rear wheel 204. The steering servomotor 201 also connects to the front assembly 202, which connects to the front wheel 202*a*. Finally, the Front brake servomotor 203 also connects to the front brake 202*b*, which connects to the front wheel 202*a*.

The transmitter 250 is configured to accept command inputs from the human operator and send those commands to the receiver 220.

The IMU 230 includes one or more accelerometers that estimate velocity changes in the direction of the orthogonal x-axis, y-axis, and z-axis and one or more gyroscopes that estimate rotational changes around the roll, pitch, and yaw axes. Other embodiments may include other sensors, such as Global Positioning System (GPS) receivers; visible light, image intensifier, or thermographic cameras, barometers, speed sensors, and the like. Although the IMU 230 is illustrated as a separate block in FIG. 2, the IMU can be integrated with other components (e.g., the control processor, receiver, or the like).

The control processor 240 uses the received commands from the operator and the sensor data from the IMU 230 to generate the output values that are used to control the drive motor ESC 205, flywheel ESC 260, steering servomotor 201, and front brake servomotor 203.

Each component may use computer storage media to save settings, such as the selected mode or target roll or pitch angle. Other embodiments may connect the IMU 230 to the receiver 220 or an ESC instead of directly to the control processor 240. Further embodiments may connect the receiver 220 to one or more ESCs. Other embodiments may include multiples of any of the components, except the rear wheel or front assembly.

Figure 3:
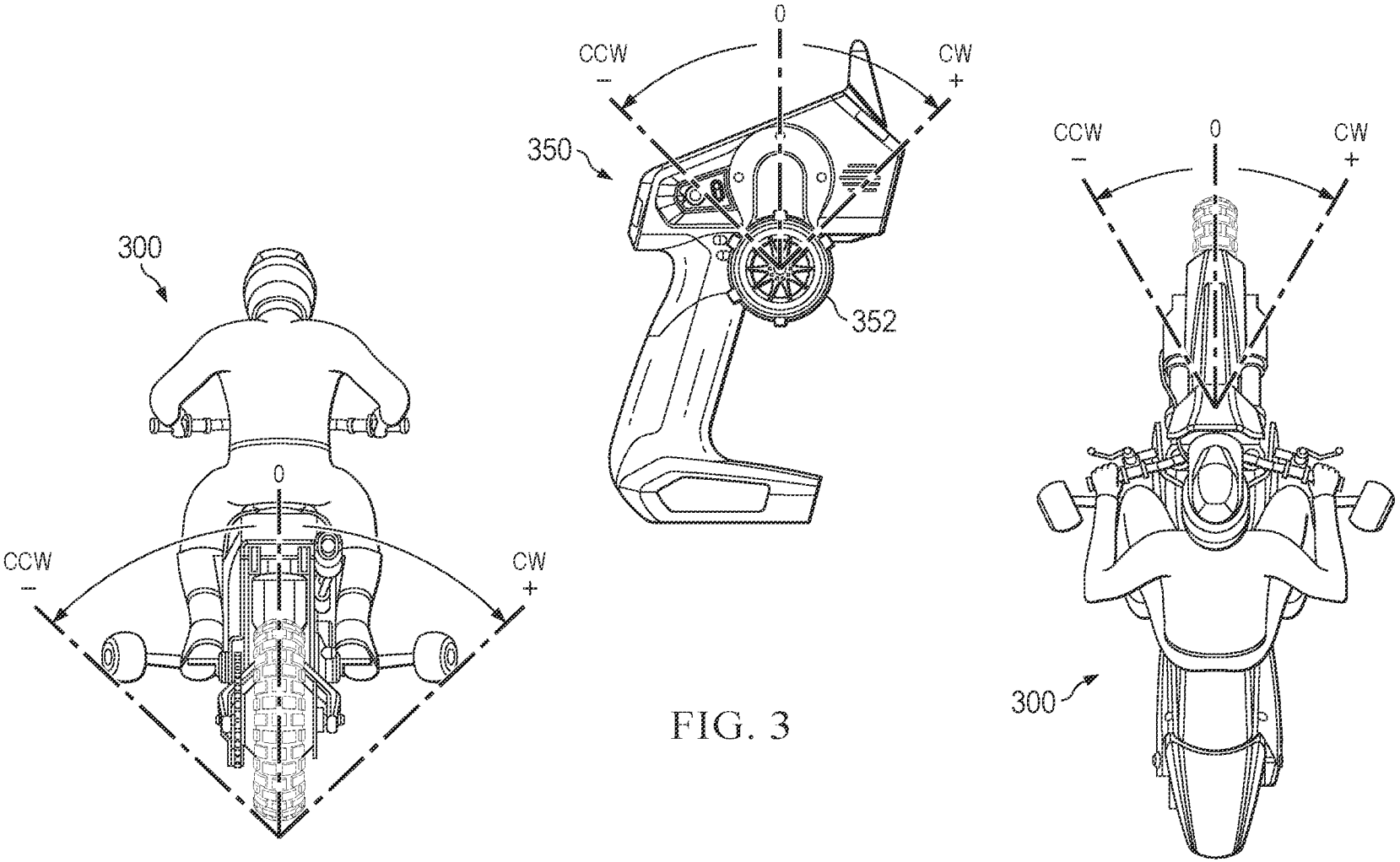
FIG. 3 illustrates the angular data inputs and outputs of the system according to an example embodiment.

FIG. 3 illustrates the angular movements of various aspects of the RC motorcycle 300 steering system. In the preferred embodiment, the steering wheel 352 of the transmitter 350 can typically rotate approximately 35 degrees in either direction, where the precise degrees of rotation depend on the specific transmitter design. When released, the transmitter steering wheel 352 is designed to mechanically return to a 0-degree neutral position (0). Rotation counterclockwise (CCW or −) from neutral is defined as negative rotation and commands a left turn, and rotation clockwise (CW or +) from neutral is positive rotation and commands a right turn. The rotations may be viewed as a percentage of travel, where full CCW rotation is −100% and full CW rotation is +100%. In some embodiments, the 0-degree neutral position (0), also referred to as a centered position, centered input, self-level input, or upright input, is an input that indicates the RC motorcycle should be maintained in an upright position.

The top view of the RC motorcycle illustrates the rotation of the front assembly around the steering axis. The steering servomotor mounted on the chassis is connected via a linkage to this front assembly to change which direction the front wheel is heading. When viewed from above looking down the axis of rotation, the front assembly can rotate approximately 25 degrees in either direction. Full CCW rotation is defined as −100% of steering travel (CCW or −), full CW rotation is +100% of steering travel (CW or +), and straight ahead in line with the rear wheel is neutral, 0 degrees and 0% of steering travel (0).

The rear view of the RC two-wheeled vehicle displays the neutral, upright roll angle (or synonymously, lean angle) of 0 degrees (0) and the physical maximum roll angles of the vehicle from approximately −50 degrees CCW (CCW or −) to 50 degrees CW (CW or +) before the lean bars contact the driving surface. These angles are approximations and are adjustable and flexible depending on, e.g., vehicle size and components, surface conditions, or other factors. The control processor uses a target roll angle that is less than the physical maximum roll angle to attempt to avoid driving with the lean bars contacting the ground.

The transmitter converts the analog rotation input of the steering wheel to a steering command digital signal, which is sent to the control processor through the receiver. Unlike previous RC motorcycles, the steering wheel rotation in some embodiments does not correspond directly to a rotation of the front assembly of the motorcycle. Instead, the control processor converts the steering command into a targeted roll angle that it will try to reach by rotating the front assembly. This front assembly rotation occurs in the opposite direction of the operator's steering command in order to shift the center of gravity of the motorcycle and lean the motorcycle towards the desired roll angle. As it reaches the desired roll angle, the control processor automatically adjusts the front assembly steering value as needed to try to maintain that target roll angle.

For example, assume a maximum target roll angle of 40 degrees for the motorcycle. In this case, if the operator turns the transmitter steering wheel to +100% (fully CW), the control processor determines the motorcycle should lean to the right (illustrated as CW or + in the rear view) by 40 degrees. In order to achieve this roll angle, the control processor will steer the front assembly in the negative direction (CCW or − in the top view), which leans the motorcycle to the right (CW or + in the rear view). The control processor monitors the reported roll angle, and as the bike approaches 40 degrees of roll angle it will steer the front assembly back in the positive direction (CW or + in the top view) to shift the center of gravity enough to maintain that target roll angle. Matching a reported attitude or angle to a target attitude or angle may be referred to as reducing the difference or reducing error between the two.

Other embodiments may use different minimums and maximums for each angular input and output. The steering commands and targeted roll angles of some embodiments may be non-linearly and/or non-proportionally correlated.

Figure 4:
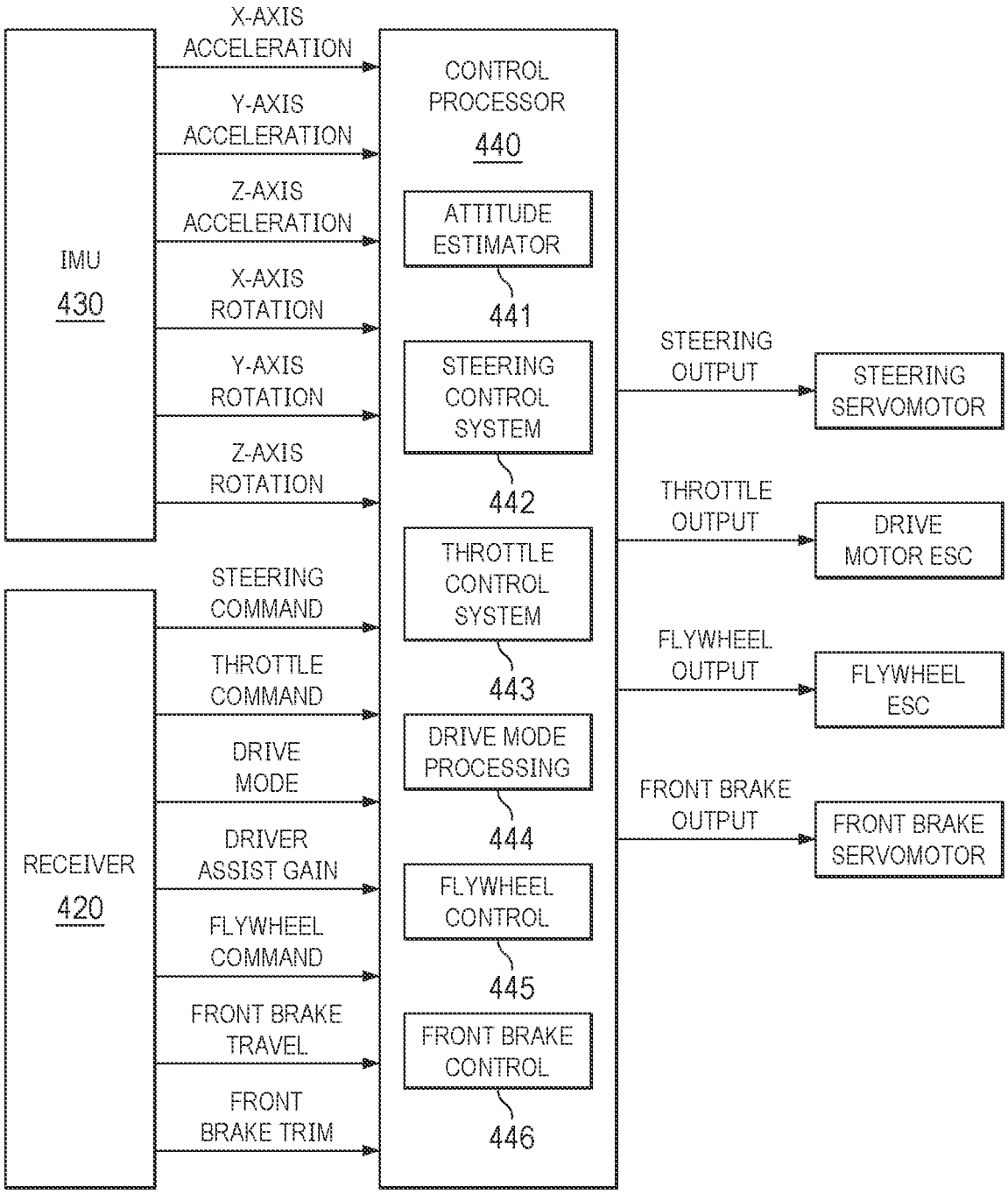
FIG. 4 illustrates a flow chart of steering and throttle control according to an example embodiment.

FIG. 4 is a block diagram showing inputs and outputs of a stability control processor. In some embodiments, the control processor is an embedded microcontroller running custom firmware stored in onboard non-volatile flash memory. FIG. 4 shows the basic inputs to the control processor 440, the general functional blocks within the control processor 440, and the outputs. The control processor 440 has firmware to handle timing differences between the inputs, execution, and outputs. In some embodiments, the control processor is a field programmable gate array (FPGA), an application-specific integrated circuit (ASIC), or a more general-purpose CPU or GPU with software or firmware stored in a different medium.

Control processor 440 receives inputs from an IMU 430. The IMU 430 provides linear acceleration values and rotation rate values for the orthogonal x, y and z axes as shown. In the example embodiment, the Attitude Estimator 441 receives these values at a rate greater than its execution rate. In some embodiments, these values are low-pass filtered and provided to the Attitude Estimator 441. The Attitude Estimator 441 is responsible for mathematically determining the inertial attitude of the vehicle, meaning its orientation referenced to gravity of the Earth. Stored orientation parameters provide a method for relating the orientation of the IMU 430 to the orientation of the overall vehicle, allowing the other control processor blocks to work with an inertial frame of reference for the vehicle. The Attitude Estimator 441 can also provide information on whether the vehicle is in free-fall, meaning the most significant acceleration acting upon it is acceleration towards the Earth due to gravity.

The control processor 440 also receives inputs from the receiver 420, including steering, throttle, drive mode, driver assist gain, flywheel, front brake travel, and front brake trim inputs. In some embodiments, the steering command is the value corresponding to the transmitter steering wheel movement, and the throttle command corresponds to the transmitter throttle lever position. These two inputs are the primary operator inputs to the steering control system and throttle control system. The drive mode input and driver assist gain values are processed in Drive Mode Processing 444 to generate a selected drive mode. The selected drive mode is used by the control processor 440 to adjust parameters of the other control blocks. The flywheel command input passes to Flywheel Control 445, where the control processor 430 determines at what rate the flywheel should spin and passes the output to the flywheel ESC 460. The front brake travel and trim values are provided to the Front Brake Control 446, where they are used with the throttle command to compute the output value to drive the front brake servomotor.

The Steering Control System 442 and Throttle Control System 443 discussed further below and in reference to FIGS. 5 and 6. Both blocks utilize one or more closed-loop control systems in combination with each other to generate steering and throttle outputs. In some embodiments, multiple Proportional-Integral-Derivative (PID) control loops are used. A PID control loop is a common closed-loop (feedback) control method that typically utilizes three specific types of gain: proportional, integral, and derivative. The proportional gain drives the output in proportion to the instantaneous error; the integral gain drives the output in proportion to the accumulated error; and the derivative gain drives the output in proportion to the instantaneous rate of change of error, where error is the difference between the targeted value and measured value. These three gain values can be individually adjusted to manipulate the response rate, rotational stop and start characteristics, overshoot or undershoot characteristics, oscillation, overall stability, and handling of the motorcycle. Individual PID gain values are determined and stored for different selected drive modes, allowing the optimization for different types of driving environment (traction, dirt, on-road, sand, mud, etc.) and varying levels of driver experience (e.g., beginner, intermediate, advanced).

In some embodiments, a PID control loop adds a feed-forward loop and associated feed-forward gain value. A feed-forward component of a PID uses a model of the expected behavior of the control system to generate an output value close to the expected target value at which the system will settle, given the PID gain values and enough time. Adding this open-loop feed-forward component to the PID can speed up the response of the control system if the feed-forward model is reasonably accurate, but adds additional risk of error and/or instability in situations the feed-forward model could not correctly anticipate.

Other embodiments of closed-loop control systems that can be used with the control processor 440 include but are not limited to: state-space feedback representation, non-linear feedback control, feedback adaptive control, intelligent control (Bayesian control/Kalman filter or Artificial Intelligence/Machine Learning methods like neural networks), and robust control methods like Lyapunov-based control.

Figure 5:
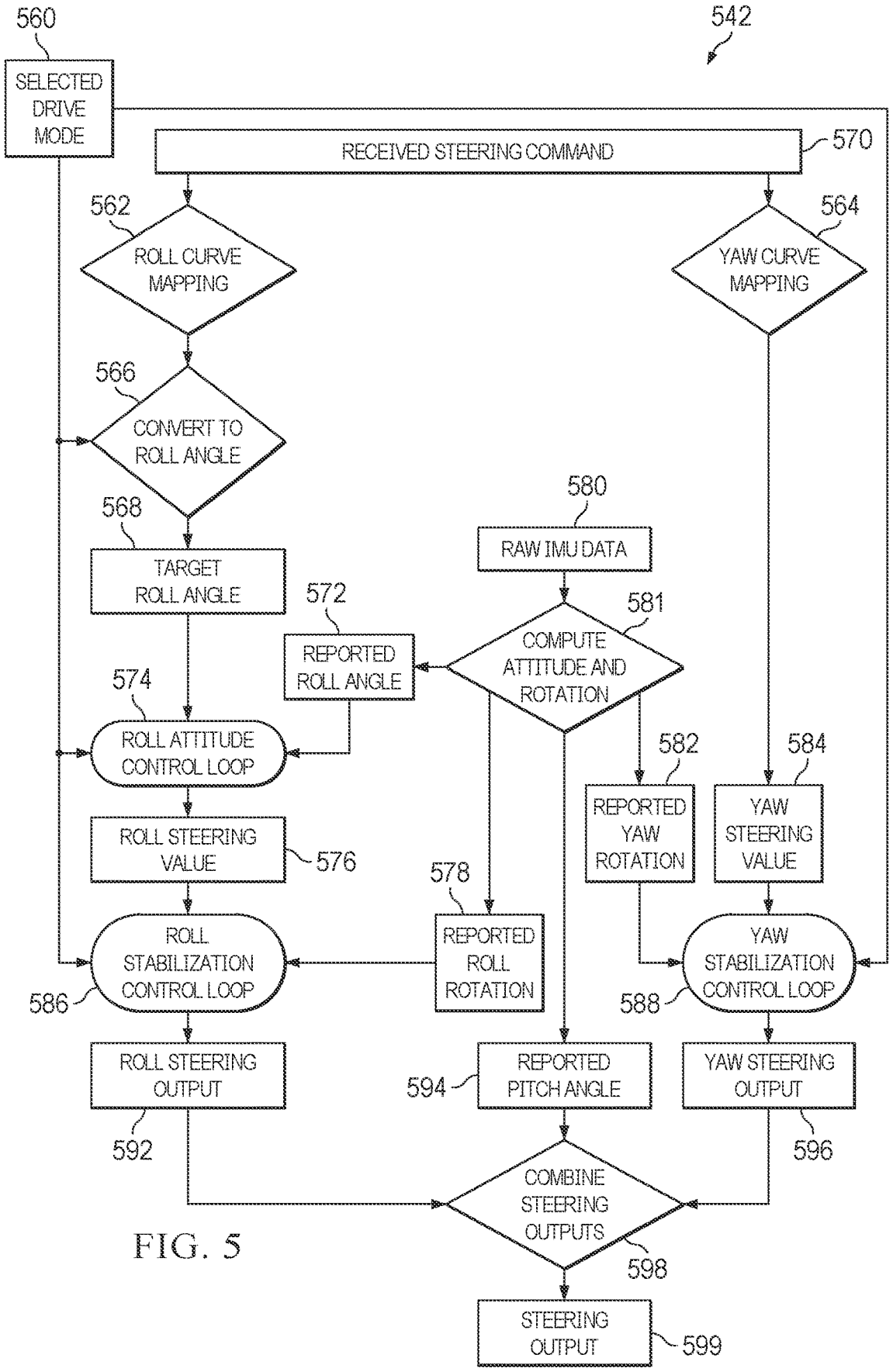
FIG. 5 illustrates a flow chart of converting a steering command into a targeted roll angle for selectable modes according to an example embodiment.

FIG. 5 illustrates a simplified flow chart of a Steering Control System 542 according to some embodiments. In operation, the Steering Control System 542 is executed continuously at a regular rate by the control processor to stabilize and steer the vehicle using the front assembly and rear wheel, based on inputs from the operator and the IMU.

In the example embodiment, there are three primary inputs to the steering algorithm: the Selected Drive Mode 560, the Received Steering Command 580 from the transmitter, and raw IMU data 580. The Received Steering Command 570 can be viewed as a linear mapping of the steering wheel angle of the transmitter to a percentage, in which the spring-loaded center position is 0%, full clockwise rotation to the end stop is 100%, and full counterclockwise rotation to the end stop is −100%. In a two-wheel vehicle such as a motorcycle, turning the vehicle involves both roll (also called lean) and yaw components. As such, the Steering Control System 542 passes the Received Steering Command 570 to two separate paths that handle roll and yaw in different feedback control loops, and then combines their resultant values back together to generate one Steering Output 599 to drive the steering servomotor.

The Selected Drive Mode 560 is a value generated in the control processor from the combination of the drive mode setting and the driver assist gain value from the transmitter (or pre-programmed or selected by the operator), and is used to adjust internal values including but not limited to the various PID control loop gain values, target angle limits, and output scaling. In some embodiments, other methods alter the Selected Drive Mode 560, either manually with additional operator adjustments, or automatically through the use of other sensors including but not limited to Global Positioning System (GPS) location, drive time, sensed battery voltage, and/or a history of past driving behavior of the vehicle, or the like.

The IMU inputs have been discussed previously, as has the attitude estimate that converts the roll, pitch, and yaw rotations and x, y, and z accelerations into an estimate of the inertial attitude. This inertial attitude is mathematically separated into a Reported Roll Angle 572 and Reported Pitch Angle 594 of the vehicle. The Steering Control System 542 uses these two reported angle values along with the Reported Roll Rotation 578 and Reported Yaw Rotation 582 values as feedback to the various steering control loops.

The first stage in both the roll and yaw algorithm paths is to allow a one-to-one mapping of the Received Steering Command 570 to an independent steering value used by that path. This independent mapping can be a curve to allow increased or decreased steering authority around the center and/or the endpoints, or it can be a straight linear relationship. The characteristics of this mapping are stored in the control processor.

The Roll Angle 566 that is output from the Roll Curve Mapping 562 is then converted into a Target Roll Angle 568. This Target Roll Angle 568 is the result of piecewise linear interpolation in which 0% roll steering equals a target roll angle of 0°, −100% roll steering equals the left target roll angle maximum, and 100% roll steering equals the right target roll angle maximum value. In other embodiments, the Target Roll Angle 568 may be calculated differently. The left and right roll angle maximum values are set based on the Selected Drive Mode 560. In some embodiments the left and right roll angle maximum values are symmetrical and within the range of about 30° to 50° from upright. For example, if the Selected Drive Mode results in a maximum roll angle of 40° then a roll steering value of −50% would result in a target roll angle of −20°, meaning the vehicle is leaned to the left by 20° when viewed from behind.

The Target Roll Angle 568 is then used as an input to the Roll Attitude Control Loop 574, and the Reported Roll Angle 572 from the Compute Attitude and Rotation 581 is used as the feedback value. In some embodiments, the difference between the Target Roll Angle 568 and the Reported Roll Angle 572 is used as the error term for the roll attitude PID loop. The PID loop gains are set to predetermined values by the Selected Drive Mode 560, allowing the control loop to be adjusted for different driving conditions by the operator. The Roll Attitude Control Loop 574 can also optionally attenuate the PID gain values based on how close the target angle is to center) (0°) to allow for a less aggressive control loop response when returning to an upright attitude after a turn.

The Roll Attitude Control Loop 574 is a factor in simplifying the driving experience for a two-wheeled vehicle operator. As previously described in reference to FIG. 3, when the operator turns the steering wheel counter-clockwise, signifying a desire to turn the vehicle to the left, the control processor must initially turn the front wheel clockwise when viewed from above (CW or + in top view). This counter-steering generates a roll movement to the left, and this shift in the center of gravity of the vehicle to the left initiates a left turn. As the Reported Roll Angle 572 of the vehicle approaches and/or reaches the Target Roll Angle 568, the Roll Attitude Control Loop 574 automatically adjusts the Roll Steering Value 576 to keep the vehicle from continuing to roll past that angle. If the Roll Attitude Control Loop 574 were not used, the operator would need to manually generate this complicated and unintuitive sequence of commands to maintain a consistent lean angle and turn radius of the vehicle.

The Roll Steering Value 576 that is generated from the Roll Attitude Control Loop 574 is then used as an input to the Roll Stabilization Control Loop 586. This control loop is set up to mitigate or minimize the Reported Roll Rotation 578 of the vehicle and attempts to counteract movements that are generated by the environment rather than the operator. The gain values for this control loop are set based on the Selected Drive Mode 560. In addition, an additional priority gain may be set that attenuates the Roll Stabilization Control Loop 586 gains based on how far the Roll Steering Value 576 is from center (e.g., front wheel pointed straight ahead) to give priority to necessary steering actions over the computed control loop corrections. In this way, the control loop can give small corrections to the steering value to overcome disturbances to the intended steering, especially when attempting to drive in a straight line. The final output of this roll-based path of the steering algorithm is the Roll Steering Output 592.

In some embodiments, the yaw algorithm path does not have an attitude-based control loop since the yaw attitude angle of the vehicle corresponds to rotation about the z-axis, or in other words the compass heading of the vehicle. In a self-driving vehicle it might be important to have a control loop for yaw attitude, but in an RC vehicle the operator chooses which direction to drive, and the control processor need not worry about absolute compass heading.

The Yaw Steering Value 584 generated by the Yaw Curve Mapping 564 passes into a Yaw Stabilization Control Loop 588. Like the Roll Stabilization Control Loop 586, this control loop tries to minimize the Reported Yaw Rotation 582 when the operator is not initiating a turn. Unintended yaw rotations can be caused by bumpy terrain, sliding on loose surfaces, poor traction, and other environmental factors. Yaw Stabilization Control Loop 588 gain values are set based on the Selected Drive Mode 560, and a yaw priority gain parameter may be used to adjust how much to attenuate those gain values as the operator commands steering values further away from center. The Yaw Stabilization Control Loop 588 is important for two-wheeled vehicles in instances of low traction, where the front or rear wheel might slide on slick, uneven or unstable surfaces.

The resulting Yaw Steering Output 596 is combined with the Roll Steering Output 592, with a pre-determined mix ratio between the two as they are added together. The Combine Steering Outputs 598 block also uses the Reported Pitch Angle 594 as an input to optionally allow the system to reduce or eliminate any steering output when the pitch angle of the vehicle is above a normal operating range to ensure that the front wheel is pointing straight ahead when the front assembly swings forward and impacts the ground after a jump or wheelie. In some embodiments, the free-fall detection of the attitude estimation routine is used to alter the steering output to prevent damage to the vehicle that can be caused if the front wheel is turned to the side when the front end impacts the ground.

The final Steering Output 599 of the steering algorithm is converted with the necessary scaling factor to use it to drive the steering servomotor of the vehicle. The effect that this steering movement has on the rotation and attitude of the vehicle before the next execution of this steering algorithm provides feedback to the various control loops so that this iterative process can run again.

Other embodiments may use the IMU, throttle value, wheel rotation sensors, and/or other sensors to estimate the forward speed of the vehicle. This speed estimate is used as an additional factor to scale the control loop gains to account for different stability requirements when driving at lower speeds versus higher speeds.

Furthermore, by combining the use of the Steering Control System 542 with a flywheel and angle limiter (e.g., lean bars), the motorcycle can recover from a stopped and leaning position without requiring the operator to handle the RC motorcycle directly. In some embodiments, the lean bars physically stop the RC motorcycle from achieving a roll angle of more than 50 degrees from vertical in either direction. The Steering Control System 542 causes the front wheel turn so that the front of the wheel points towards the ground, regardless of which side RC motorcycle is leaning on the ground. Furthermore, this occurs regardless of the operator's input on the transmitter steering wheel, because the RC motorcycle's monitored roll angle exceeds the limits of the targeted roll angle. Finally, the flywheel is internally coupled the RC motorcycle chassis near the center of inertia along the medial plane and powered by an electric motor attached to an ESC directed by the control processor or receiver. From the perspective of the RC motorcycle's right side, the flywheel spins clockwise.

Figure 6:
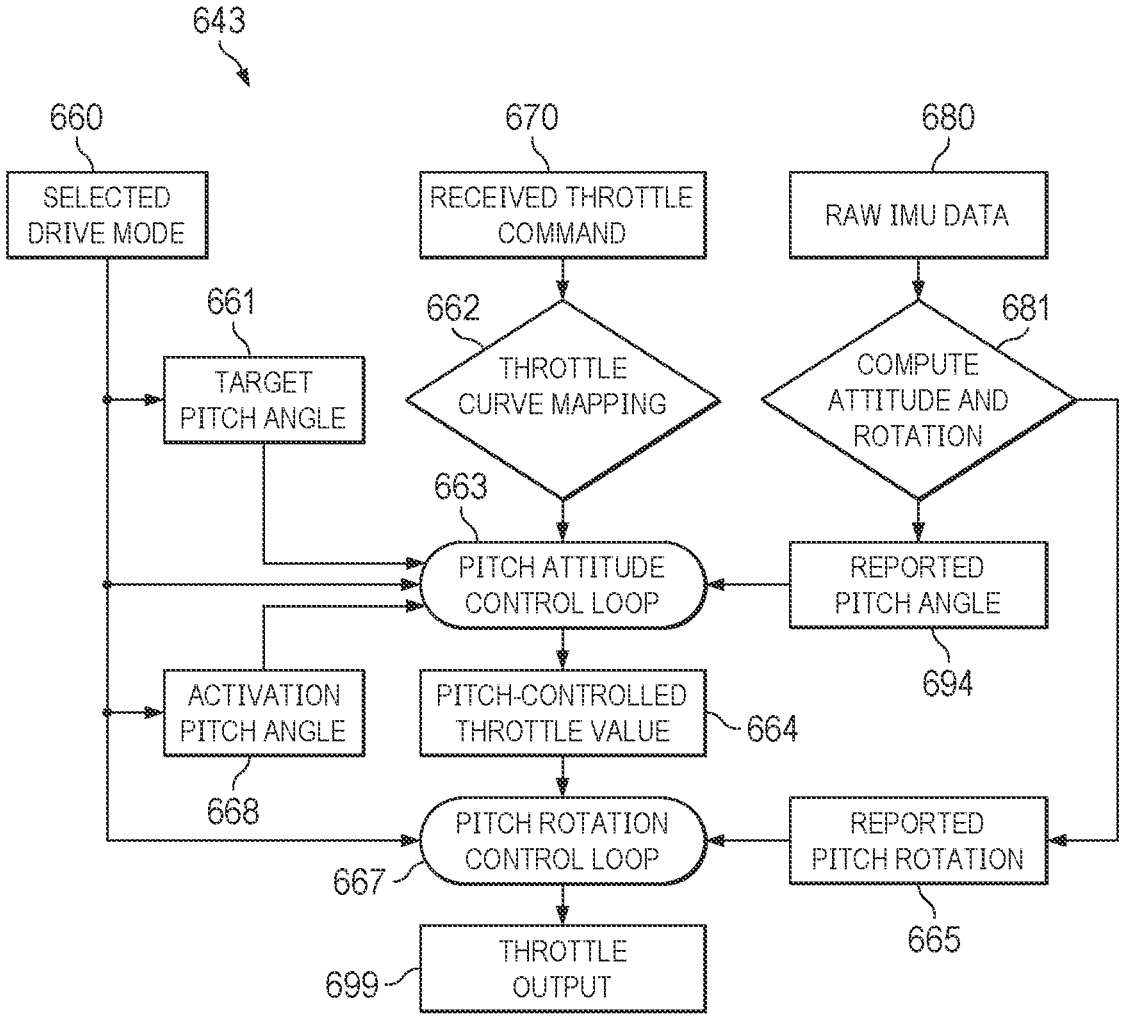
FIG. 6 illustrates a flow chart for selectable modes according to an example embodiment.

FIG. 6 illustrates a simplified flow chart of a Throttle Control System 643 according to the example embodiment. In operation, the algorithm is executed continuously at a regular rate by the control processor to modify the Throttle Output 699 that drives the rear wheel, based on inputs from the transmitter and the IMU. The primary purpose of these throttle-based control loops is to detect and control and/or suppress wheelies in the vehicle. A wheelie is a vehicle maneuver in which the front wheel or wheels come off the ground (e.g., due to sufficient torque being applied to the rear wheel or wheels).

In some embodiments, there are three primary inputs to the throttle algorithm: the Received Throttle Command 670 from the transmitter, the Selected Drive Mode 660, and raw IMU data 680. The Received Throttle Command 670 can be viewed as a one-to-one mapping of the position of the transmitter throttle lever to a percentage value, in which the spring-loaded center position is 0%, pulled back towards the hand grip to the limit is 100%, and pushed forward away from the hand grip to the forward limit is −100%. In some embodiments, positive throttle values from the operator are interpreted as a request for forward motion of the vehicle, and negative throttle values request a braking action to slow the forward motion. In other embodiments, the first application of a negative throttle after a positive throttle command would still request braking, but a return to 0% followed by another negative command requests that the vehicle drive in reverse.

The Selected Drive Mode 660 and Raw IMU Data are the same or similar to those described in FIG. 5. The Reported Pitch Angle 694 is computed from the inertial attitude estimate, and the Reported Pitch Rotation 665 is provided by the IMU.

The first stage of the Throttle Control System 643 is a Throttle Curve Mapping 662, which enables an optional one-to-one mapping of the Received Throttle Command 670 to a throttle value used by the Pitch Attitude Control Loop 663. This independent mapping can be a curve to allow increased or decreased throttle or brake authority around the center and/or the endpoints, or it can be a straight linear relationship. The characteristics of this mapping are stored in the control processor.

The Pitch Attitude Control Loop 663 uses the output of the Throttle Curve Mapping 662 as the base throttle value. The Reported Pitch Angle 694 from the Compute Attitude and Rotation 681 functions as a feedback value for the control system, where the error term is the difference between the Reported Pitch Angle 694 and the Target Pitch Angle 661. In the example embodiment, this control loop is a PID, and the output value is used to modify the base throttle value to generate a Pitch-Controlled Throttle Value 664.

The Target Pitch Angle 661 and Activation Pitch Angle 668 are both set by the Selected Drive Mode 660. When the Reported Pitch Angle 694 of the vehicle is less than the Activation Pitch Angle 668, the throttle value is passed through the Pitch Attitude Control Loop 663 unmodified, and directly becomes the Pitch-Controlled Throttle Value 664. When the Reported Pitch Angle 694 is greater than the Activation Pitch Angle 668, the control loop is activated and the Pitch-Controlled Throttle Value 694 may be modified to try to reach the Target Pitch Angle 661. For safety reasons, the control loop is not allowed to increase the throttle output beyond what the operator requested when trying to reach the Target Pitch Angle 661. Through selection of target and activation angle values and PID gains for each Selected Drive Mode 660, the system can be tuned to either maintain a wheelie for an extended length of time without user adjustment, or can be set to suppress wheelies if the Target Pitch Angle 661 is lower than the Activation Pitch Angle 668.

The Pitch Rotation Control Loop 667 uses the Reported Pitch Rotation 665 as a feedback input. This control loop uses the average of the Reported Pitch Rotation 665 over an adjustable period of time based on the Selected Drive Mode 660 to assess if a wheelie is in progress, and can provide an additional braking force to the Pitch-Controlled Throttle Value 664 to mitigate or minimize the Reported Pitch Rotation 665 while the wheelie is in progress.

The final Throttle Output 699 modified by these control loops is converted with the necessary scaling factor for use in driving the drive ESC, which in turn drives the motor that ultimately turns the rear wheel and propels the vehicle forward. The Selected Drive Mode 560 and subsequent control loop gain values determine whether that Throttle Output 699 is tuned to assist the operator to maintain a wheelie at a given angle or suppress wheelies to keep the vehicle from flipping due to excessive acceleration and/or torque on the rear wheel.

In some embodiments, an adjustable reduction of the Throttle Output 699 based on the reported roll angle is used to assist the system in avoiding wheelies as the vehicle is leaned too far to be able to accurately maintain a wheelie.

In some embodiments, a sensor is used in the front wheel assembly to detect when the front wheel lifts off the ground to assist wheelie detection. This could be accomplished by detecting the compression or extension of the mechanical front suspension system using a potentiometer, Hall effect sensor, photodiode, load cell, strain gauge, ultrasonic transducer, or some other force or position sensor or camera system.

The above-disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A radio-controlled (RC) motorcycle, comprising:

a chassis, comprising a rear wheel and a steerable front wheel assembly;

an inertial measurement unit (IMU) comprising one or more angular rate sensors configured to output rotation data associated with rotation of the RC motorcycle about one or more axes, and one or more acceleration sensors configured to output acceleration data associated with acceleration of the RC motorcycle along one or more axes;

an attitude estimator, configured to calculate an attitude estimate of the RC motorcycle using the rotation and acceleration data from the IMU;

a receiver;

a brake coupled to the rear wheel; and a control processor, electrically connected to the receiver configured to:

receive a steering input from an RC transmitter;

receive an attitude estimate from the attitude estimator;

determine a target roll angle based at least in part on the steering input from the receiver;

determine a reported roll angle from the attitude estimate;

control a steering angle of the front wheel assembly to reduce error between the target roll angle and the reported roll angle;

store a pitch angle activation threshold, maximum pitch rotation rate threshold, and target pitch angle;

determine a reported pitch angle and a reported pitch rotation rate based on data from the attitude estimator and inertial measurement unit;

compare the pitch angle activation threshold and maximum pitch rotation rate threshold to the reported pitch angle and the reported pitch rotation rate respectively; and when either the pitch angle activation threshold or the maximum pitch rotation rate threshold are exceeded, control the RC motorcycle to avoid flipping over.

2. The RC motorcycle of claim 1, wherein the control processor is further configured to:

store a maximum roll angle; and control the steering angle to prevent the RC motorcycle from exceeding the maximum roll angle.

3. The RC motorcycle of claim 1, wherein the control processor is further configured to determine an upright input based on the steering input from the RC transmitter.

4. The RC motorcycle of claim 3, wherein the upright input is determined based on the steering input being indicative of a centered steering input on the transmitter, and wherein the control processor, based at least in part on the upright input, is further configured to control the RC motorcycle to maintain an upright position.

5. The RC motorcycle of claim 1, wherein the control processor is further configured to stabilize a yaw angle.

6. The RC motorcycle of claim 5, wherein the yaw angle is stabilized by a closed-loop control system in the control processor that adds stabilization corrections to the steering angle based on a reported yaw rotation from the inertial measurement unit.

7. The RC motorcycle of claim 1, wherein the control processor is further configured to stabilize a pitch angle.

8. The RC motorcycle of claim 1, wherein controlling the RC motorcycle to avoid flipping over comprises a closed-loop control system that reduces a throttle or applies the brake to reduce an error between the target pitch angle and the reported pitch angle.

9. The RC motorcycle of claim 8, wherein the target pitch angle is selected to be near a balance point of the RC motorcycle about a pitch rotation axis, allowing the RC motorcycle to maintain the target pitch angle.

10. The RC motorcycle of claim 1, further comprising:

an angle limiter configured to maintain the RC motorcycle at a minimum roll angle relative to ground;

wherein the control processor is further configured to:

determine the reported roll angle is close to the minimum roll angle;

receive a throttle input from the receiver; and control the steering angle to stand the motorcycle up.

11. A control processor for an RC vehicle, configured to:

receive angular rotation data associated with rotation of the RC vehicle about one or more axes and acceleration data associated with acceleration of the RC vehicle along one or more axes;

calculate a roll angle estimate of the RC vehicle, based on the rotation data and the acceleration data;

receive steering command data from a controller associated with the RC vehicle; calculate a target roll angle, based on the steering command data;

control the steering angle of at least one wheel of the RC vehicle to reduce error between the target roll angle and the roll angle estimate; and determine a self-level input based on the steering input from the RC transmitter;

wherein the self-level input is determined based on the steering input being indicative of a centered steering input on the transmitter.

12. The control processor for an RC vehicle of claim 11, wherein the control processor is further configured to:

store a maximum roll angle; and control the steering angle to prevent the RC vehicle from exceeding the maximum roll angle.

13. The control processor for an RC vehicle of claim 11, wherein the control processor is further configured to stabilize a yaw angle.

14. The control processor for an RC vehicle of claim 13, wherein the yaw angle is stabilized by a closed-loop control system in the control processor that adds stabilization corrections to the steering angle based on a reported yaw rotation.

15. The control processor for an RC vehicle of claim 11, wherein the control processor is further configured to:

store a pitch angle activation threshold, maximum pitch rotation rate threshold, and target pitch angle;

determine a reported pitch angle and a reported pitch rotation rate based on data from the attitude estimator;

compare the pitch angle activation threshold and maximum pitch rotation rate threshold to the reported pitch angle and the reported pitch rotation rate respectively; and when either the pitch angle activation threshold or the maximum pitch rotation rate threshold are exceeded, control the RC vehicle to avoid flipping over.

16. The control processor for an RC vehicle of claim 15, wherein controlling the RC vehicle to avoid flipping over comprises a closed-loop control system that reduces throttle or applies the brake to reduce error between the target pitch angle and the reported pitch angle.

17. The control processor for an RC vehicle of claim 16, wherein the target pitch angle is selected to be near a balance point of the RC vehicle about a pitch rotation axis.

* * * * *